United States Patent [19]

Monne

[11] Patent Number: 4,508,063

[45] Date of Patent: Apr. 2, 1985

[54] MOBILE POSITIONING BODY INTRODUCTION DEVICE

[75] Inventor: Maxime Monne, Paris, France

[73] Assignee: INTERCONTROLE Société Anonyme, France

[21] Appl. No.: 494,935

[22] Filed: May 16, 1983

[30] Foreign Application Priority Data

May 19, 1982 [FR] France ..... 82 08787

[51] Int. Cl.[3] ..... F22B 37/42

[52] U.S. Cl. ..... 122/504; 165/75; 165/76

[58] Field of Search ..... 122/396, 493, 496, 504, 122/511, 512; 165/70, 71, 72, 75, 76, 78, 79; 414/728, 750, 909

[56] References Cited

U.S. PATENT DOCUMENTS 4,018,344 4/1977 Leshem ..... 165/76
4,148,403 4/1979 Riffe ..... 165/76
4,212,583 7/1980 Gebelin ..... 165/76
4,302,146 11/1981 Finlayson et al. ..... 165/76
4,373,855 2/1983 Lebouc ..... 165/76

FOREIGN PATENT DOCUMENTS 2431109 8/1980 France .

*Primary Examiner*—Edward G. Favors
*Assistant Examiner*—Steven E. Warner

[57] ABSTRACT

The present invention relates to a device for introducing a mobile positioning body onto a tube plate of a steam generator through a manhole.

The device comprises two substantially parallel rails essentially shaped like a curved angle plate, whereby a trolley can slide along the rails and on which can be placed the said moving body. During the introduction of the moving body, the device is provisionally fixed to the tube plate by lugs and to the inner face of the manhole by a pedal maintained in place by a spring.

Application to the inspection of steam generator tubes.

5 Claims, 8 Drawing Figures

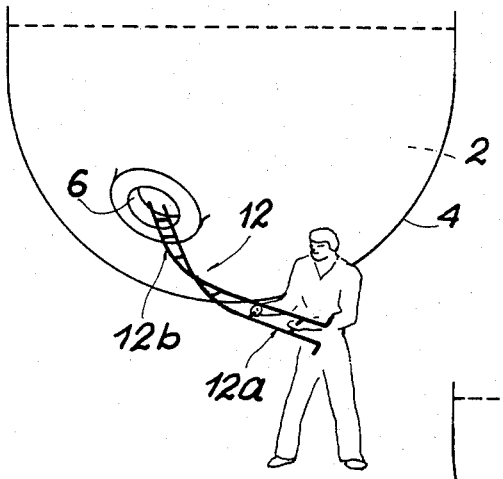
FIG. 2a
FIG. 2b
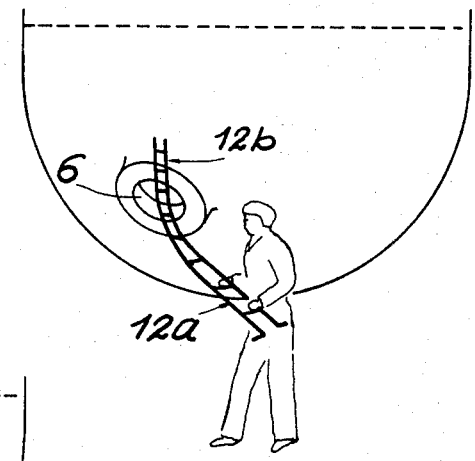
FIG. 2c
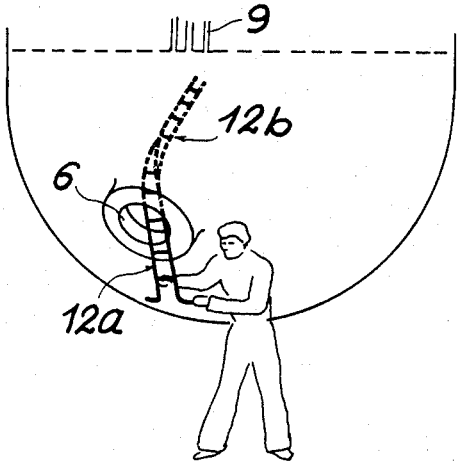
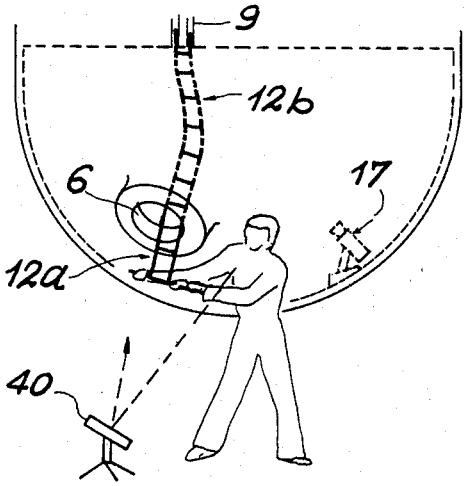
FIG. 2d

MOBILE POSITIONING BODY INTRODUCTION DEVICE

BACKGROUND OF THE INVENTION

The present invention relates to a device for introducing a mobile positioning body of a member onto a tube plate, applicable more particularly to the introduction of mobile positioning bodies intended to successively face all the tubes of the tube bundle of the steam generator of a nuclear power station.

Steam generators comprise a bundle of exchanger tubes, communicating by a tube plate with a water box or compartment, located in the lower part of the generator. The water box is subdivided into a hot part and a cold part, separated by a vertical partition. The installation of moving bodies used for positioning members in front of the holes, whereby said members can e.g. be probes for detecting leaks or faults in the tubes, takes place by human intervention. When it is a self-supporting moving body, the latter is fitted by an operator, who enters the water box and leaves it as soon as fitting has taken place. If it is a supported moving body, e.g. fixed to a rotary arm, it is also necessary for an operator to enter the water box in order to install the rotary arm system.

In both cases, the operator, who has to enter the water box by an opening called a manhole, is exposed to the action of ionizing radiation, whose level is much higher within the water box than outside the manhole. To avoid exposing personnel to such radiation, attempts have been made to use systems permitting the fitting of the moving body without it being necessary for an operator to enter the water box and, if possible, designed in such a way that the operator is outside the envelope hyperboloid of the cones of the trajectories of ionizing rays.

Moreover, in most existing systems, the device remains in place once the moving body has been fixed to the tube plate, which may prevent or disturb the inspection of certain tubes if, for example, the moving body is a probe-carrying body.

BRIEF SUMMARY OF THE INVENTION

The present invention relates to a device for introducing a mobile positioning body into the water box of a steam generator, obviating the need for an operator to enter the water box and which can be extracted therefrom once the positioning body is in place on the tube plate.

According to the main feature of the device according to the invention, said device comprises two substantially parallel rails, joined by crosspieces, the assembly having essentially the shape of a curved angle plate, and means making it possible to extract it from the water box, once the moving body has been fixed to the tube plate.

The function of the two rails is to permit the raising of a trolley supporting the mobile positioning body from the exterior of the manhole and up to the tube plate. However, in general, the manhole axis is inclined by 45° relative to the horizontal. It is therefore necessary for each of the rails to have two more or less linear parts, in such a way that one of them, located outside the water box and in the manhole, is inclined by 45° relative to the horizontal, whilst the other positioned within the water box is vertical. Thus, the device is generally in the form of an angle plate, whose angle is 135°. Moreover, in most cases, the manhole axis is also inclined by 45° relative to the side of the lattice structure defined by the system of holes of the tube plate. The part of the rails located within the water box must therefore have a curved configuration, in order that the line passing through the upper ends of the rails is parallel to one of the sides of the thus defined lattice structure. The aforementioned term "curved angle plate" means that the rails must have a shape making it possible to compensate these two 45° displacements.

The means used for extracting the device from the water box, once the mobile positioning body has been fixed to the tube plate comprise means making it possible to provisionally fix it to the tube plate and means making it possible to provisionally fix it in the vicinity of the manhole.

According to a first embodiment, the means making it possible to provisionally fix the device to the tube plate comprise, at one end of each of the rails, a rigid lug able to enter a hole in the tube plate, whereby one of the lugs has a greater length than the other in order that when the first lug has been placed in a hole of the tube plate, it is possible, by pivoting the assembly, to bring the second lug into another hole in the plate.

According to another embodiment, the means making it possible to provisionally fix the device to the tube plate comprise, at one end of each of the rails, an inflatable lug or stud able to enter a hole in the tube plate, in order to maintain the assembly in place after inflation.

The means making it possible to provisionally fix the device in the vicinity of the manhole comprise, according to the preferred embodiment, a pedal which can be maintained on the inner face of the manhole with the aid of a spring. In this case, the pedal is retractable so as to permit the introduction of the device according to the invention into the manhole, as well as the extraction thereof, once the mobile positioning body has been fixed to the tube plate.

The device according to the invention also comprises means making it possible to move the mobile positioning body along the rails and which can comprise a trolley able to slide along the rails, a cradle which can be fixed to the trolley and on which can be placed the mobile positioning body and means making it possible to slide the trolley along the rails.

Finally, according to a final feature of the device according to the invention, the latter is equipped with means making it possible to accurately place it in the immediate vicinity of a moving body already placed on the tube plate, said means comprising, according to a preferred embodiment, two cables, whose ends are fixed to the moving body, the cables passing in guide tubes located in the upper part of the rails. As a variant, only a single cable may be used, or more than two cables may be used.

BRIEF DESCRIPTION OF THE DRAWINGS

The invention is described in greater detail hereinafter relative to non-limitative embodiments and the attached drawings, wherein show:

FIGS. 2*a* to 2*d* diagrammatic views illustrating the various stages of introducing the rails constituting the device in the water box.

DETAILED DESCRIPTION OF THE PREFERRED EMBODIMENTS

Figure 1:
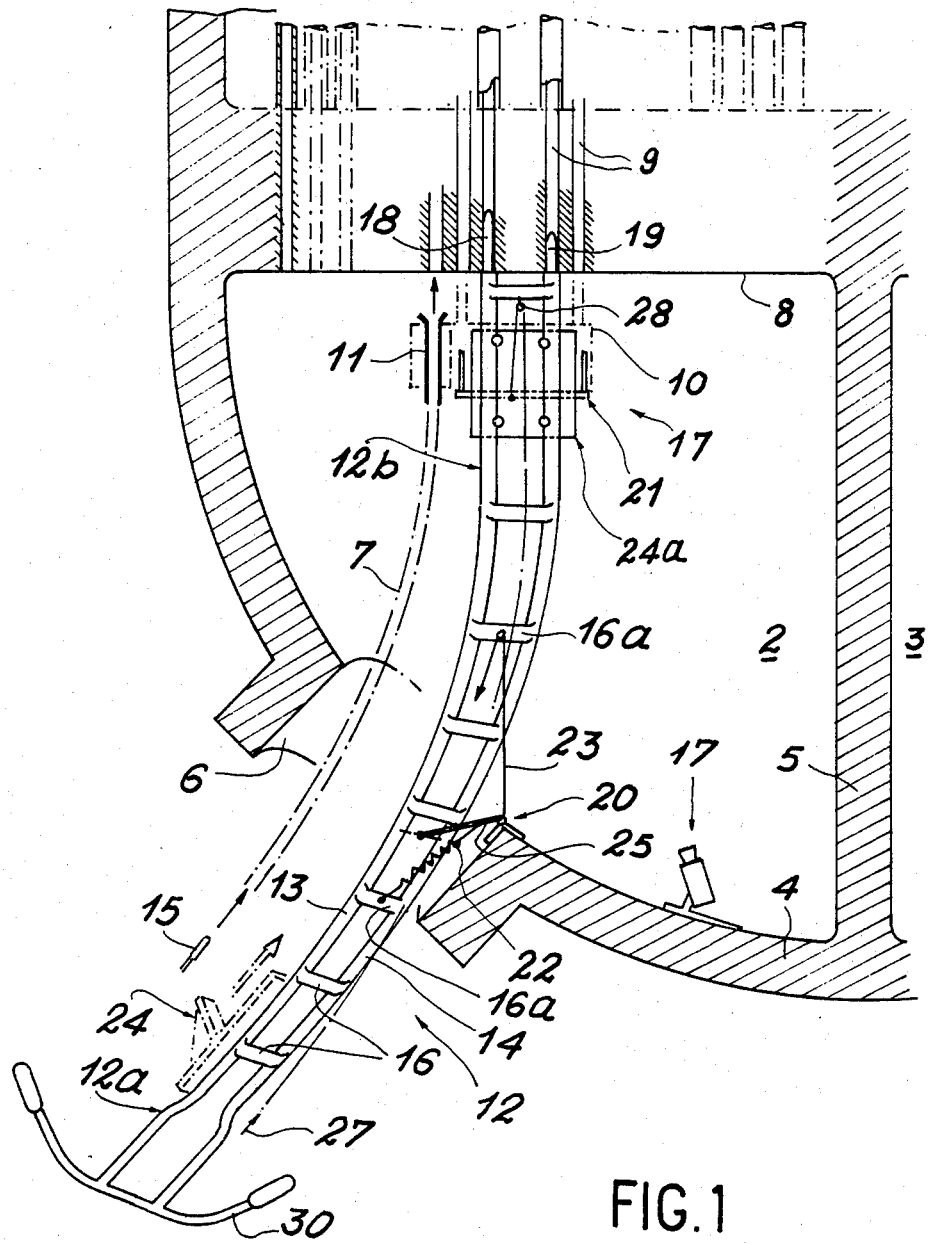
FIG. 1 a diagrammatic sectional view of the water box of a steam generator showing the device according to the invention.

The sectional view of FIG. 1 shows the lower part of a steam generator, where it is possible to see two half-water boxes 2, 3, separated by a partition 5, whilst the half-water box 2 is separated from the outside by a thick wall 4 having an access opening or manhole 6. In the upper part of water box 2 is located a tube plate 8, having a certain number of holes, through which enter the exchanger tubes 9 of the generator. To permit the introduction into the water box 2 and the fixing in the holes of tube plate 8 of a mobile positioning body 10, diagrammatically shown by dot-dash lines in the drawing, and which can e.g. be a support for a probe guide 11, use is made of the device illustrated in the drawing and which carries the general reference numeral 12.

This device essentially comprises two substantially parallel rails 13, 14, connected by crosspieces 16, the assembly being essentially shaped like a curved angle plate. Thus, it is possible to see in the drawing that the device comprises two more or less linear parts 12*a*, 12*b*, connected by a curved central part. The lower part 12*a* is roughly parallel to the manhole axis, while the upper part 12*b* is vertical. Moreover, the upper part 12*b* has a curved shape, in order that the upper ends of the rails are aligned with the sides of the lattice structure, defined by the system of tubes. This double curvature of the rails 13, 14 can also be seen in the plan view of FIG. 3.

In order to be able to fix the device in tube plate 8, the ends of the rails 13, 14 have rigid lugs 18, 19 respectively, which can be introduced into the holes of the tube plate. It is obvious that the spacing of the rails 13, 14 at their upper end must be equal to an integral number of times the pitch of the lattice structure, defined by the holes 9, in order that the lugs 18, 19 enter the holes. As can also be seen in FIG. 1, lug 18 is longer than lug 19, in order to facilitate the positioning of assembly 12, prior to the introduction of moving body 10. Initially, lug 18 is introduced into a hole, then the assembly is pivoted until lug 19 can enter another hole.

The device also has means making it possible to fix it to wall 4, in the vicinity of the manhole, prior to the introduction of moving body 10. In the variant illustrated in FIG. 1, the assembly constituted by rails 13, 14 is fixed to the lower part of the cylinder defined by the passage of the manhole in wall 4, by means of a pedal 20 operated by a spring 22.

FIG. 1 also shows that the device has means making it possible to move moving body 10 along rails 13, 14. These means essentially consist of a trolley 24, diagrammatically shown by dot-dash lines in the drawing in its starting position and by solid lines in its arrival position 24*a*. A cable 27, passing over a pulley 28 located in the upper part of rails 13, 14 and whereof one end is fixed to trolley 24, whilst the other is fixed to the lower part of the rails, makes it possible to slide trolley 24 along the latter. According to a preferred embodiment, the cable can be connected to a turnbuckle, but other equivalent means can be used, e.g. a winch.

Finally, a handlebar member 30, located at the lower end of the rails, cooperates in the introduction of the device into the manhole. The weight of the assembly is sufficiently low to enable this operation to be carried out by one man, particularly as the rails alone are introduced first, prior to the installing of the mobile positioning body 10 on trolley 24. The latter remains permanently on the rails, which have a lightweight construction.

The device operates in the following way. On wishing to introduce the mobile positioning body 10 into water box 2 of the steam generator, the device constituted by rails 13, 14 is firstly put into place. This first operation takes place in several stages, as illustrated by FIGS. 2*a* to 2*d*. In FIG. 2*a*, it can be seen that the water box 2 of the steam generator is separated from the outside by wall 4, in which is formed the manhole 6. Firstly (FIG. 2*a*), the lower part 12*a* of the device is kept substantially horizontal, whilst part 12*b*, whose introduction into manhole 6 has commenced, slopes by 45°. The operator positions himself laterally with respect to the manhole, or optionally behind the latter, with his back to the steam generator, so that he is not exposed to radiation. This is followed by the pushing of the assembly (FIG. 2*b*), part 12*a* progressively arriving at an almost vertical position, whilst part 12*b* is inclined by 45°. The position of FIG. 2*c* is then reduced, in which the device is almost entirely introduced into the water box. It then merely remains necessary to manipulate the assembly (FIG. 2*d*) to introduce the end of rails 13, 14 into the holes of the tube plate. The final position is then reached, in which the upper part 12*b* of the device is substantially vertical and the lower part 12*a* is substantially inclined by 45°. The latter operation can be facilitated by a mirror 40 making it possible to observe the tube plate from the outside of the water box. In certain cases, the mirror can be replaced by a display screen, connected to a camera 17 placed in the water box. The shape of the device and the use of display means during the final stage of introduction ensure that at no time is the operator forced to be positioned in the axis of the manhole, so that the risks of contamination by radiation are considerably reduced.

To fix the upper ends of rails 13, 14 in the holes of the tube plate, the rigid lug 18 located at the end of rail 13 (FIG. 1) is introduced into a hole in the tube plate and then, when this has taken place, the assembly is pivoted in order that the rigid lug 19, which is shorter than lug 18, can enter another hole in the tube plate. At this time, the rails are fixed relative to wall 4, by using pedal 20 and spring 22. The latter is connected on the one hand to a crosspiece 16*a* of the device, and on the other hand to a lever 25, whereof one end is fixed to another point of the structure constituted by rails 13, 14 and crosspiece 16. Pedal 20 is mounted on the other end of lever 25. FIG. 1 illustrates the locking position in which spring 22 exerts a tensile stress on lever 25, thus engaging pedal 20 with the inner face of wall 4. When it is wished to disengage the assembly, it is merely necessary to pull on cable 23, which has the effect of bringing spring 22, lever 25 and pedal 20 along rails 13, 14. Here again, there is no need for the operator to face the manhole in order to manipulate the cable controlling pedal 20.

Once the introduction device according to the invention is in place and is fixed in the vicinity of manhole 6, the mobile positioning body 10 is placed on trolley 24, which is located in its starting position in the lower part of the device. Generally, a cradle, whose shape and dimensions are adapted to those of each of the mobile positioning bodies to be introduced, is placed on trolley 24, body 10 being placed on the cradle. Then, using cable 27, trolley 24 is raised up to position 24*a*, where body 10 can be fixed in the holes of tube plate 8. Optionally, a camera 17, fixed to an element of the steam generator structure, makes it possible to observe the tube plate 8 on an external display screen and to accurately mark the position where moving body 10 has been placed. It is also possible to place the camera on the mobile positioning body, but this solution has the disadvantage of making the equipment which has to be hoisted up to the tube plate significantly heavier. When body 10 is in place, pedal 20 is disengaged by pulling on cable 23 and device 12 is extracted from the water box. It is then possible to introduce probe 15 in probe guide 11 through a per se known introduction device, e.g. a guide tube 7, and as diagrammatically shown by the broken lines in the drawing.

Figure 3:
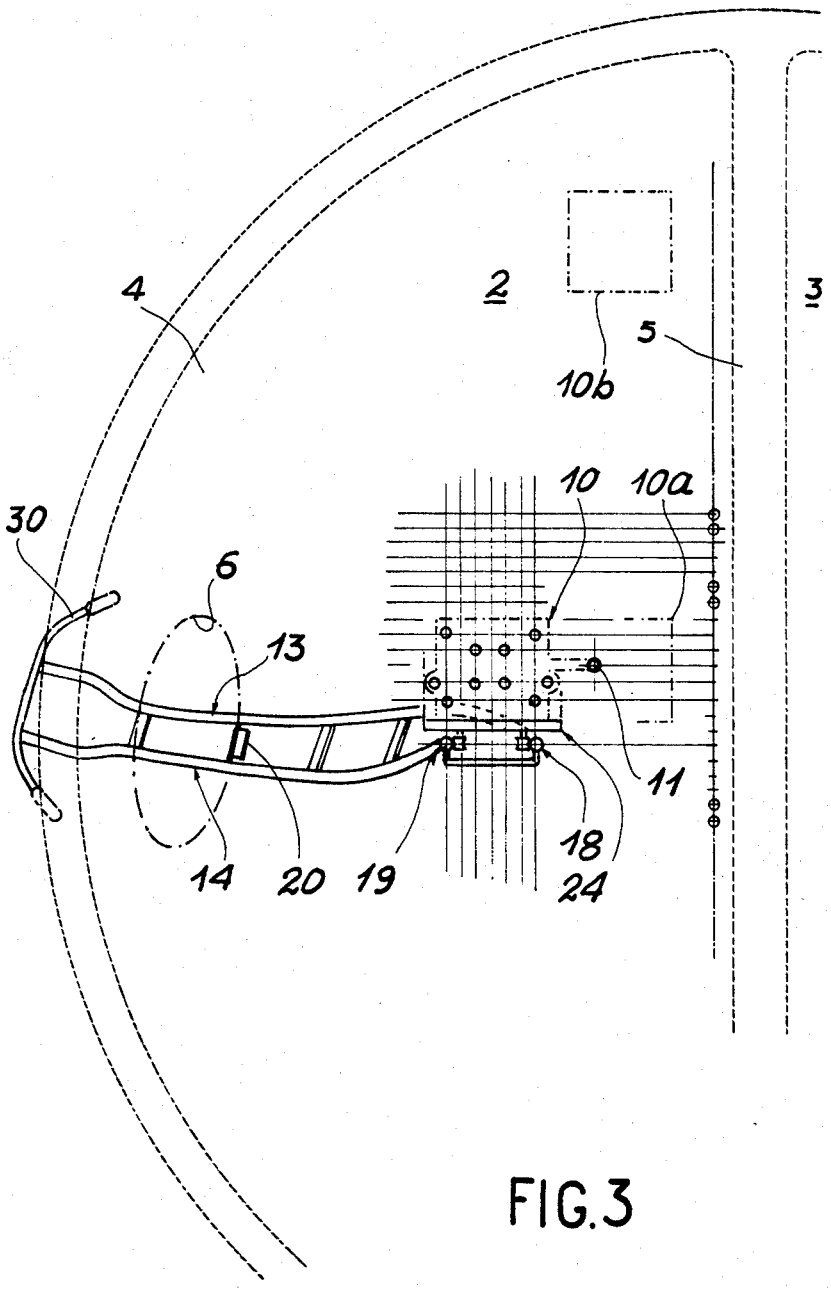
FIG. 3 a plan view of the same device.

Once the introduction device has been removed, the mobile positioning body 10 can move along the tube plate 8 and assume all possible positions such as 10*a* and 10*b*, diagrammatically represented by broken lines in the plan view of FIG. 3. It is then possible to inspect all the tubes of plate 8, without being disturbed by the presence of the introduction device. When all the tubes of plate 8 have been inspected, the moving body is brought into its initial position and once again the device according to the invention is used for extracting it from the water box.

A problem can arise at this time, because it is not certain that the moving body has returned precisely to its starting position and difficulties can be encountered in positioning the device according to the invention in the immediate vicinity of said body. This problem is solved by a special feature of the invention, diagrammatically illustrated in the sectional view of FIG. 4.

Figure 4:
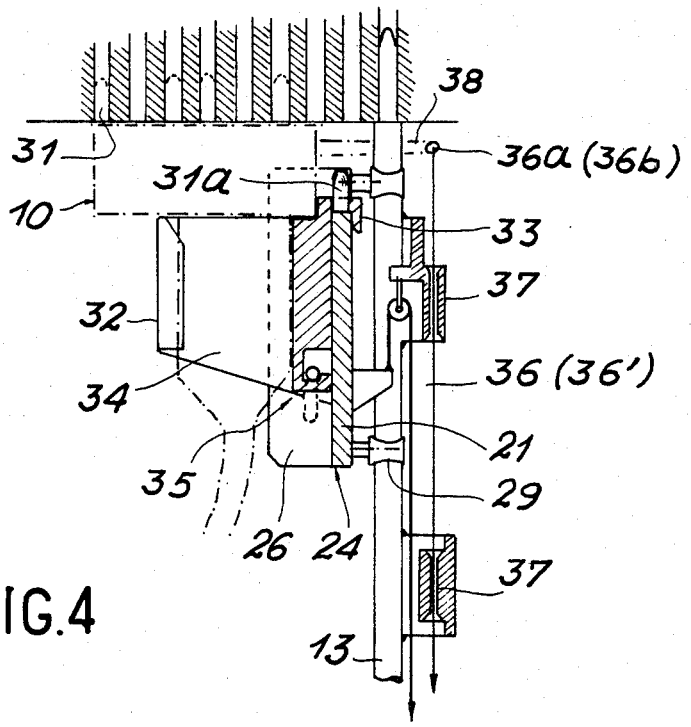
FIG. 4 a larger scale, diagrammatic, sectional view similar to FIG. 1, showing how it is possible to place the device according to the invention in the immediate proximity of the mobile positioning body, already placed on the tube plate.

FIG. 4 shows moving body 10 fixed in the holes of plate 8 by means of e.g. expansion clips or clamps 31. It is also possible to see trolley 24, which comprises a chassis 21, bordered by two flanges 26 and able to travel along rails 13, 14 by means of rollers 29. A cradle 32, used for supporting moving body 10, is mounted on chassis 21 between flanges 26. In the embodiment of FIG. 4, cradle 32 is attached to the upper part of trolley 24 by means of tabs 33, held laterally in place by eyelets 31*a*, fixed to the said trolley. In its lower part, cradle 32 has two flanges, which can be maintained against the flanges 26 of trolley 24 by means of a locking device or a nesting system 35. It is clearly not essential for trolley 24 and cradle 32 to be equipped with flanges and without passing beyond the scope of the invention it is also possible to use any equivalent means for fixing these two members to one another.

FIG. 4 also shows the device making it possible to place rails 13, 14 precisely in the vicinity of moving body 10. This device essentially comprises two cables 36, 36', whereof the ends 36*a*, 36*b* are fixed to moving body 10. For reasons of clarity, an extension 38 of the latter is shown to which is attached the end 36*a* of cable 36, but this can be fixed to any random point of moving body 10. The positioning of the attachment points of ends 36*a*, 36*b* of cables 36, 36' must be carefully chosen, so as to not prejudice the fitting of the device according to the invention and so as not to impede the movements of the trolley. Cables 36, 36' pass into one or two guide tubes 37, arranged in the upper part of rails 13, 14.

Figure 5:
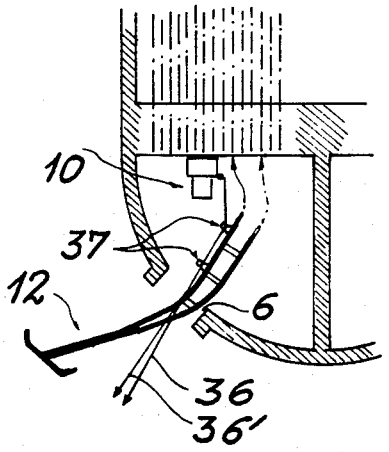
FIG. 5 a diagrammatic sectional view illustrating the introduction of the rails into the water box with the aid of the device shown in FIG. 4.

On wishing to seek out moving body 10, once it has returned to a position close to its initial position, the free end of cables 36, 36' is introduced into guide tubes 37, on starting to push device 12 into manhole 6. As cables 36, 36' are kept permanently taut, device 12 automatically moves towards moving body 10 as it is introduced into the water box 2 of the steam generator and as diagrammatically illustrated by FIG. 5. As there are in general two cables 36, 36', this not only makes it possible to move the upper part of rails 13, 14 closer to moving body 10, but also makes it possible to orient them in such a way that they are again precisely positioned in the position shown in FIG. 4. It is then possible to raise trolley 24 with cradle 32, which is therefore also correctly oriented to receive moving body 10. The latter is disengaged from the tube plate 8 and it is possible to extract it from the water box.

The device according to the invention has particularly interesting advantages, because it makes it possible to introduce a mobile positioning body onto a steam generator tube plate, without an operator having to enter the water box. Moreover, it has a simple construction, is relatively inexpensive and is sufficiently light to enable one man to manipulate it. Moreover, it is possible to extract it from the water box, once the mobile positioning body has been fixed to the tube plate, which enables said body to pass over the entire surface of the plate and e.g. check all the tubes. Finally, the extraction of the moving body is facilitated by the cables 36, 36', which enable the rapid and reliable positioning of the device in the immediate vicinity of the moving body 10 with the correct distance and with the correct orientation.

Finally, it is obvious that the invention is not limited to the embodiment described hereinbefore and also covers all the variants thereof. For example, in the case of an embodiment in which the device is fixed to the lower part of the manhole 6 by spring 22 and pedal 20, without passing beyond the scope of the invention, it is possible to use a variant in which rails 13, 14 are fixed to the upper part of manhole 6 by a random fixing system. Trolley 24 is then no longer positioned in the manner shown in FIG. 1 and is instead to some extent suspended on rails 13, 14. Furthermore, in place of the described embodiments in which the rails have rigid lugs 18, 19 in their upper part, which facilitate their positioning in the holes of plate 8 and fixing means at the manhole, it is also possible to have a variant in which lugs 18, 19 are replaced by inflatable lugs used for maintaining the device in the holes of tube plate 8. In the latter case, rails 13, 14 can be constituted by hollow tubes used for supplying compressed air to the inflatable lugs.

What is claimed is:

1. A device for introducing a mobile positioning body for a member onto a tube plate of a steam generator, said generator comprising a water box having a wall provided with a manhole, said device comprising:

a structure defined by two substantially parallel rails joined by crosspieces, each of said rails having an upper end and a lower end and said structure also having an upper end and a lower end and being substantially shaped like a curved angle plate, means for provisionally fixing said structure to the tube plate, means for provisionally fixing said structure in the vicinity of the manhole comprising a lever having two ends, one end of which is pivotally fixed to said structure, a pedal mounted at the other end of said lever, a spring having two ends, one end of which is fixed to said structure and the other end of which is fixed to said lever, and means for pivotally moving said lever operable from outside the water box and behind the manhole comprising a cable having two ends, one end of which is fixed to said lever and the other end of which is outside the water box, and means for moving the mobile positioning body along the rails.

2. A device according to claim 1, wherein said tube plate has holes therein and said means for provisionally fixing said structure to the tube plate comprise rigid lugs fixed at the upper end of each of the rails, one of the lugs having a greater length than the other lug, whereby, when the longer lug has been placed in a hole of the plate, the device is pivotable to bring the shorter lug into another hole of said plate.

3. A device according to claim 1, wherein said means for provisionally fixing said structure to the tube plate comprise an inflatable lug provided at the upper end of each of the rails.

4. A device for introducing a mobile positioning body for a member onto a tube plate of a steam generator, said generator comprising a water box having a wall provided with a manhole, said device comprising:

a structure defined by two substantially parallel rails joined by crosspieces, each of said rails having an upper end and a lower end and said structure also having an upper end and a lower end and being substantially shaped like a curved angle plate, means for provisionally fixing said structure to the tube plate, means for provisionally fixing said structure in the vicinity of the manhole, said means for provisionally fixing said structure in the vicinity of the manhole being operable from outside the water box and behind the manhole, and means for moving the mobile positioning body along the rails comprising a trolley slidably mounted on said rails, a cradle mounted on said trolley, the mobile positioning body being placed on said cradle, and means for sliding the trolley along the rails comprising a cable having two ends, one end of which is fixed to said trolley, said cable passing over a pulley provided at the upper end of said structure and having its other end outside the water box.

5. A device for introducing a mobile positioning body for a member onto a tube plate of a steam generator, said generator comprising a water box having a wall provided with a manhole, said device comprising:

a structure defined by two substantially parallel rails joined by crosspieces, each of said rails having an upper end and a lower end and said structure also having an upper end and a lower end and being substantially shaped like a curved angle plate, means for provisionally fixing said structure to the tube plate, means for provisionally fixing said structure in the vicinity of the manhole, said means for provisionally fixing said structure in the vicinity of the manhole being operable from outside the water box and behind the manhole, means for moving the mobile positioning body along the rails, and means for accurately placing said device in the immediate vicinity of a moving body already positioned on the tube plate comprising two cables, each having two ends, one end of which is fixed to said moving body, and first and second guide tubes mounted on each of said rails respectively, said cables fixed to said moving body passing into said guide tubes.

* * * * *